US006112497A

United States Patent [19]

Credle, Jr.

[11] Patent Number: 6,112,497

[45] **Date of Patent: *Sep. 5, 2000**

[54] VARIETY PACK VENDOR AND METHOD OF USING

[75] Inventor: William S. Credle, Jr., Stone Mountain, Ga.

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,158

[22] Filed: Jun. 30, 1997

[51] Int. Cl.[7] ..... B65B 21/00; B65B 71/00

[52] U.S. Cl. ..... 53/48.5; 53/48.3; 53/168; 53/398; 53/448

[58] Field of Search ..... 53/448, 445, 168, 53/398, 48.1, 48.2, 48.3, 48.4, 48.5, 543, 154, 237, 474; 221/2, 191, 192, 194, 95, 133, 97, 1

[56] References Cited

U.S. PATENT DOCUMENTS

| | | | |
|---|---|---|---|
| 2,929,181 | 3/1960 | Poupitch | 53/398 |
| 3,242,631 | 3/1966 | Whiteford | 53/398 |
| 3,383,827 | 5/1968 | Schaich | 53/448 |
| 3,864,898 | 2/1975 | West | 53/328 |
| 3,871,156 | 3/1975 | Koenig | 53/168 |
| 3,977,150 | 8/1976 | Culpepper | 53/398 |
| 4,628,666 | 12/1986 | Lems | 53/398 |
| 4,787,533 | 11/1988 | Haroutel | 221/133 |
| 4,986,441 | 1/1991 | Kanbe et al. | 221/133 |
| 5,048,719 | 9/1991 | Empl | 221/133 |
| 5,088,269 | 2/1992 | Thelen | 53/398 |
| 5,125,506 | 6/1992 | Galbierz et al. | 221/97 |
| 5,176,288 | 1/1993 | Craven | 221/133 |
| 5,205,436 | 4/1993 | Savage | 221/1 |
| 5,230,206 | 7/1993 | Christ | 53/168 |
| 5,240,139 | 8/1993 | Chirnomas | 221/2 |
| 5,348,061 | 9/1994 | Riley | 221/2 |
| 5,392,953 | 2/1995 | Maldanis et al. | 206/151 |
| 5,445,287 | 8/1995 | Center et al. | 221/1 |
| 5,481,855 | 1/1996 | Yuyama | 53/168 |
| 5,499,707 | 3/1996 | Steury | 221/2 |
| 5,630,310 | 5/1997 | Chadwell | 53/384.1 |
| 5,651,476 | 7/1997 | Percy | 221/133 |

FOREIGN PATENT DOCUMENTS

| | | |
|---|---|---|
| 0465833 | 1/1992 | European Pat. Off. . |
| 2095422 | 2/1972 | France . |
| 2611465 | 9/1988 | France . |

*Primary Examiner*—Peter Vo
*Assistant Examiner*—James Calve
*Attorney, Agent, or Firm*—Finnegan, Henderson, Farabow, Garrett & Dunner, L..L.P.

[57] ABSTRACT

A vending machine is provided for packaging a plurality of articles into a unitary package. This vending machine includes a packaging area and a packer. The packer affixes a carrier to the discrete articles in the packaging area to form the package. The formed package is then discharged from the vending machine. The present vending machine therefore provides for forming a plurality of articles into a package within a single vending machine. A consumer can select what articles, such as different brands of beverage containers, which are combined to form the package. Also, the number of articles for each package can be selected by the consumer.

57 Claims, 10 Drawing Sheets

VARIETY PACK VENDOR AND METHOD OF USING

BACKGROUND OF THE INVENTION

1. Field of the Invention

The present invention relates to a vending machine and a method of packaging and vending wherein a plurality of articles are combined within the vending machine in order to form a package.

2. Description of the Background Art

Various vending machines are known. While different types of articles can be vended from a vending machine, no vending machines are known which can combine different articles into a single package. In particular, no vending machine is currently known whereby a consumer can select different types of articles to be combined into a package within the vending machine. Such a package is convenient for the consumer to carry away the selected products.

In the beverage art, no vending machine is known whereby different types of beverages can be combined into a single package. Such a package can include a six-pack, twelve-pack or any other suitable sized grouping of cans, bottles or other type of beverage containers.

SUMMARY OF THE INVENTION

Accordingly, it is a primary object of the present invention to provide a vending machine and method which can store a plurality of different types of articles and which can combine selected articles into a package which is vended.

Because a coin vend arrangement and/or bill validator can be omitted from the present machine as will be described below, it should be noted that the use of the term "vending machine" or "vendor" is not to imply that this machine must be coin operated.

It is a further object of the present invention to enable a consumer to select the types of articles which are combined into a package within the vending machine.

It is a further object of the present invention to make a vending machine and method which are simple to operate and are reliable.

These and other objects of the present invention are fulfilled by a vending machine comprising:

a packaging area for receiving a plurality of articles; and a packer for packing the plurality of articles in the packaging area into a unitary package.

These and other objects of the present invention are also fulfilled by a method of packaging and vending a plurality of articles from a vending machine, comprising the steps of:

selecting a plurality of articles from a group of articles;

grouping the plurality of articles to a packaging area within the vending machine; and combining the plurality of articles in the packaging area into a package, the combining occurring within the vending machine.

Moreover, these and other objects of the present invention are fulfilled by a carrier for a plurality of containers, the carrier having a plurality of raised walls, each of the walls surrounding and defining an opening in the carrier, each wall being sloped and one of the containers being insertable into the opening with sloping of the walls aiding alignment thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
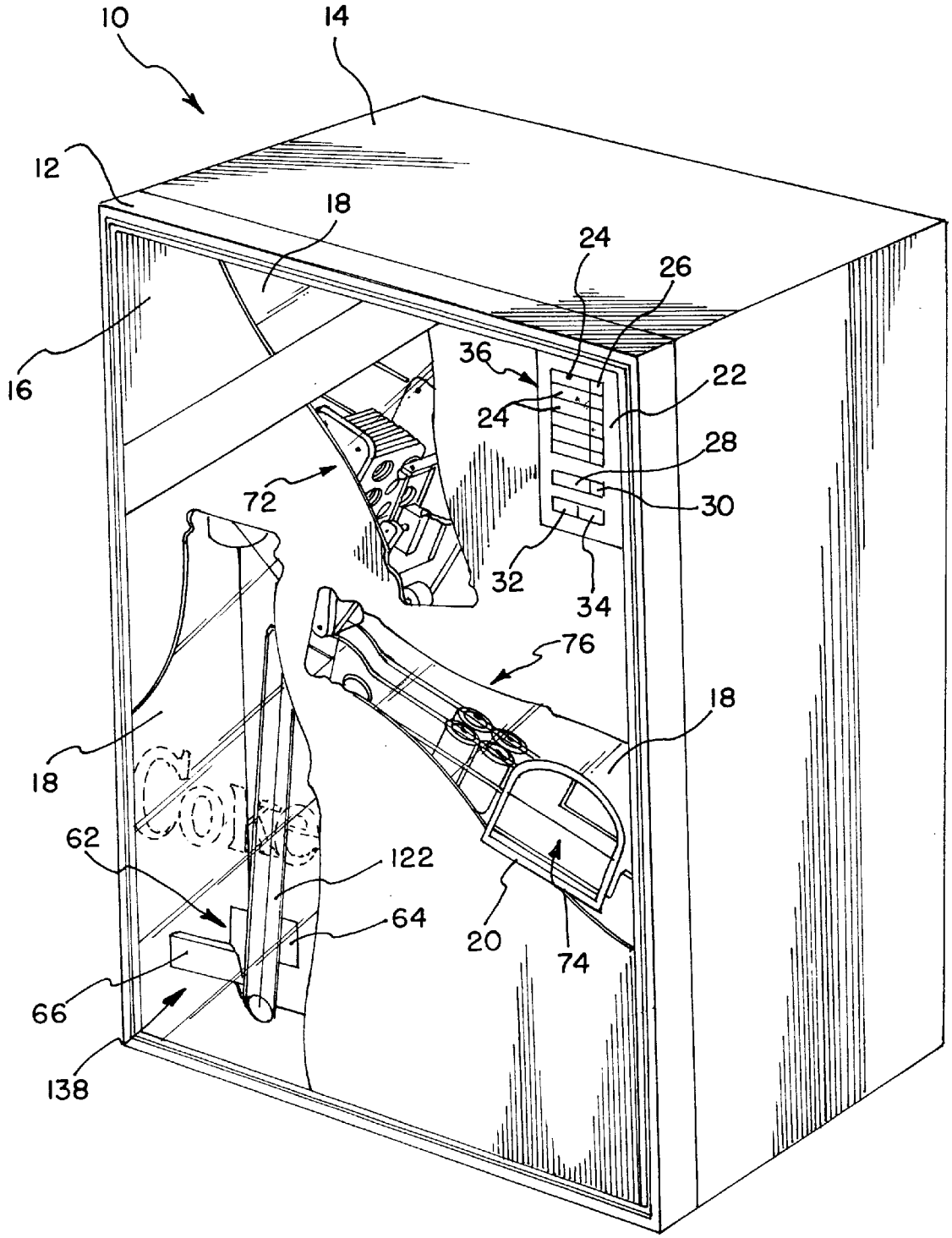
FIG. 1 is a front perspective view of a first embodiment of the vending machine of the present invention.

In FIG. 1, a first embodiment of the vending machine 10 is shown. This vending machine 10 includes a pivotable door 12 and a vending machine body 14. The door 12 is pivotable on body 14 in a known manner. On the face of door 12 is a display panel 16. This panel 16 can have any suitable graphics thereon. It should be noted that the contour bottle and the mark "Coke®" are registered trademarks of The Coca-Cola Company of Atlanta, Ga.

The display panel 16 has a plurality of windows 18 provided therein. These windows 18 are in the shape of the contour Coca-Cola® bottle. The interior portions of the door 12 are visible through these windows 18. While certain shaped windows have been indicated in FIG. 1, any suitable design can be provided. For example, oval, square or any other shaped windows or number of windows can be provided. In fact, the entire display panel 16 or a majority or other portion of this panel could be transparent in order to permit viewing of the components within the door 12. Of course, this panel 16 could also be without windows such that the interior of the door was hidden from view. The panel 16 can also be flat as shown or be bowed, provided with indentations or concave portions or have any suitable shape.

The display panel 16 on the front of door 12 has a port 20. A package formed in the vending machine 10 can be retrieved through this port 20 as will be described in more detail below.

Also on the face of the door 12, a selection panel 22 is provided. A row of selection buttons 24 are shown on the selection panel 22. Adjacent each of the selection buttons 24 is an indicator 26. Each of the selection buttons 24 can indicate a type of article to be selected for vending from the machine. Such a type of article can be a brand of beverage or any other suitable item. It is contemplated that a plurality of articles will be combined to form a single package in the present invention. For purposes of discussion, the vending machine 10 of the present invention will be described as forming six-packs. As was noted with respect to the second embodiment of the vending machine 160, the first embodiment of the vending machine 10 can combine articles to form eight-packs, twelve-packs or any other suitable number of articles can be combined into a package in the present invention. In fact, only two articles could be combined if so desired. Moreover, as will be described later, a single vending machine 10 could vend more than one size package.

As noted above, the present invention will now be described as forming a six-pack in the vending machine 10. This six-pack can be made from all of the same brand of beverage or it can have different brands of beverages in a single six-pack. It is contemplated that the vending machine 10 will be used for vending beverages but of course any other product can be vended therefrom. The beverages can be in cans, bottles or any other suitable container. While the present invention will be described as handling beverage containers and in particular beverages cans, it should be appreciated that the present invention should not be limited thereto.

When a six-pack of beverage containers is to be vended from port 20, a consumer will first activate selection panel 22. Six selections or actuations will therefore be necessary in order to have six containers to form the six-pack. Each of the six selections could be a same brand of product or could be any combination of brands of products held by machine 10. For example, the consumer can press the same button six times in order to vend the same brand of beverage to the six pack. Alternatively, different selection buttons could be depressed in order to select different combinations of beverages. Since a six-pack is being formed, up to six different beverages could be provided in six-pack. Of course, any desired combination of beverages could be compiled into a package as will be described in detail below.

Moreover, it is possible to design the machine 10 such that less than a normal package is formed. In other words, if a machine 10 were to dispense six-packs, an override switch could be provided whereby five or less beverages were dispensed to form the package if so desired. In other words, the machine could be arranged to dispense up to six items if it were designed to be a six pack vendor. Moreover, as will be discussed later, a single machine 10 could be designed to dispense different sized packages. The same machine could dispense both six and twelve-packs, for example.

When the consumer activates the uppermost button 24 in the selection panel 22, the indicator 26 adjacent this button will indicate numeral "1". If this same button is again activated, the adjacent indicator 26 will then indicate numeral "2". Therefore, the consumer will know how many of a particular brand of beverage have been selected for the six-pack.

While six selection buttons 24 and indicators 26 have been indicated in FIG. 1, any suitable number of selection buttons 24 can be used. Also, instead of using indicators 26 adjacent each of the selection buttons, a separate display could be provided for informing the consumer of how many beverages and what type of beverages have been selected.

Beneath the row of selection buttons 24 is an information panel 28 and a total selection display 30. This information panel 28 informs the consumer of the appropriate number of beverages which should be selected. In this example, the consumer will be informed that six selections should be made. Each time one of the selection buttons 24 is activated, the total selection display 30 will indicate the number of items selected. Therefore, a running tally is provided to aid the consumer in determining when the appropriate number of beverages have been selected for the six-pack.

Beneath the information panel 28 and total selection display 30 are a start button 32 and a reset button 34. When six beverages have been selected and the consumer is satisfied with his or her selection, they can then press the start button 32 in order to cause the six-pack to be formed and vended. On the other hand, if the consumer accidently selects the wrong beverage or number of beverages, the reset button 34 can be depressed. Upon activation of this reset button 34, the consumer can then reinput their desired selection through the selection buttons 24.

The selection panel 22 of the present invention is part of the controller 36 for controlling vending of articles. The controller 36 will determine when the appropriate number of articles has been selected. If a consumer selects too few articles and attempts to press the start button 32, the indicators 26 and display 30 will flash to give some indication to the consumer that more items are needed. On the other hand, if more than six items are selected, then an indication can also be given to the consumer. The controller 36 will not permit the cycle to start when the button 32 is activated until the appropriate number of articles has been selected. Again, it should be noted that while six articles are described, any suitable number of articles can be vended from the machine 10 of the present invention. For example, a single article could be vended during a given cycle of operation, if so desired. In the example of forming a six-pack, when the selection buttons 24 have been activated six times, the start button 32 is activated. This will then begin an operation cycle of the present invention.

Turning now from FIG. 1 to FIG. 4A, the interior of the vending machine body 14 will now be discussed. It will initially be noted that within this vending machine body 14, conventional refrigeration equipment is not shown. This helps to reduce the cost of the vending machine and provides extra space within the vending machine 10. The front of the vending machine 10 as seen in FIG. 1 should also be noted as being without a coin vend arrangement and/or bill validator. It is contemplated that the present vending machine 10 can be in a grocery store or convenience store, for example. The consumer will then assemble their six-packs using the vending machine 10. They can then take the assembled six-pack to another location in the store and pay for it. Such six-packs will not normally be immediately consumed and therefore there is no need to refrigerate the beverages. It should again be noted that because the coin vend arrangement and/or bill validator can be omitted from the machine 10 that the use of the term "vending machine" or "vendor" is not to imply that this machine must be coin operated.

However, it is possible that conventional coin vending equipment and/or bill validators can be included in the vending machine 10 of the present invention. Also, conventional refrigeration equipment can be utilized in the present vending machine. Therefore, the vending machine can be located at any desired place. For example, the vending machine could be on the street, in an office, or any other suitable local. It is not necessary that the vending machine 10 only be used in a grocery store or convenience store.

Figure 5:
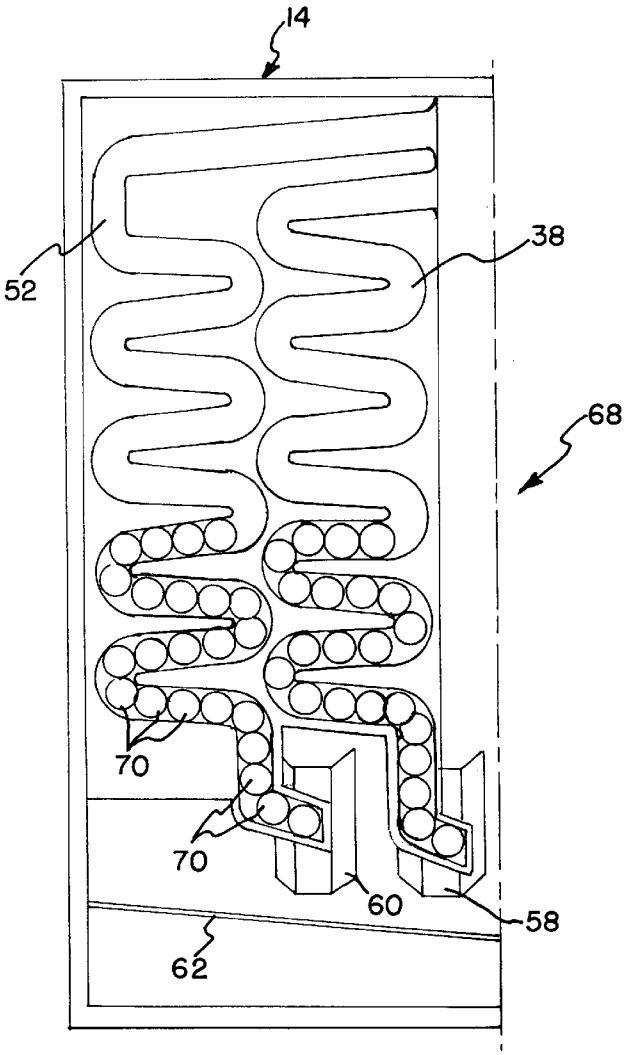
FIG. 5 is a partial side view taken along line V—V of FIG. 4A showing the first embodiment of the interior of the vending machine.
Figure 4A:
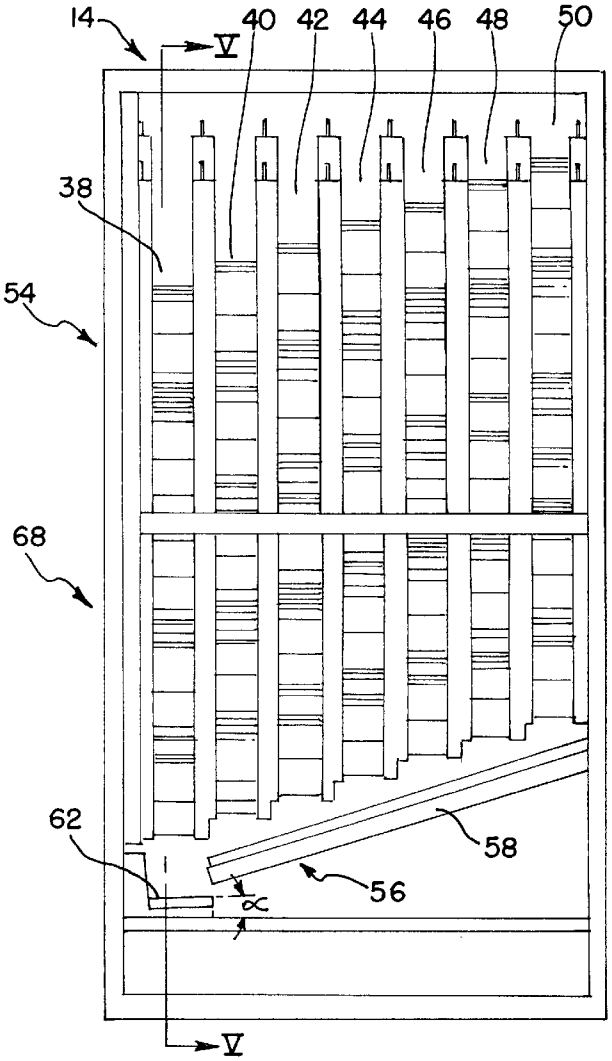
FIG. 4A is a front view of a first embodiment of the interior of the first embodiment of the vending machine showing the storage area.

In FIG. 4A, seven forward columns 38, 40, 42, 44, 46, 48 and 50 are provided. These columns will receive the individual cans for storage. As seen in FIG. 5, the left-handmost column 38 of FIG. 4A is shown. Behind this front column 38 is a second column 52. Each of the columns 38, 40, 42, 44, 46, 48 and 50 will have a column behind it. Therefore, a total of 14 storage columns is provided in the present invention. These columns have a serpentine shape in order to maximize the storage space of the present invention as shown in FIG. 5. These columns act as a plurality of holding areas 54. These holding areas 54 house the beverage containers to be dispensed. As previously noted, any suitable article can be vended from the vending machine 10 of the present invention. Therefore, other suitable storage arrangements are possible.

The articles are dispensed from each of the individual columns to an underlying ramp 56. The articles will drop from the column onto the ramp 56 in a conventional manner. It should be noted that the ramp 56 is generally the same distance from the bottom of each of the columns. When the cans of beverages are dispensed, for example, they will be positioned such that their end with the opening is facing the left in FIG. 4A. Therefore, the selected can will drop from one of the forward columns 38 through 50 or from one of the rear columns onto the ramp 56. It is contemplated that the cans or articles will drop about one eighth of an inch. The opening of the can will then be facing the left-hand wall of the vending machine body 14.

As seen in FIG. 5, a first ramp section 58 and a second ramp section 60 are provided. The second ramp section 60 is hidden behind the first ramp section 58 in FIG. 4A. Both of these ramp sections 58, 60 feed to a third ramp section 62. The third ramp section is generally perpendicular to the first and second ramp sections 58, 60. All of the ramp sections 58, 60 and 62 extend from the ramp 56 and extend downwardly for gravity feed of articles therefrom.

In FIG. 4A, the third ramp section 62 is at an angle $\alpha$ relative to the horizontal plane. This angle aligns the third ramp section 62 with the first and second ramp sections 58, 60. In particular, if the third ramp section 62 were horizontal, cans or other articles would have a greater distance to drop from the first and second sections 58, 60 onto the third ramp section 62. This dropping tends to twist the cans such that there uppermost ends no longer face the left-hand wall of the vending machine 10 as seen in FIG. 4A. In other words, the cans try to turn lengthwise. This twisting could result in the cans becoming misaligned. If the cans were sufficiently turned lengthwise, they would no longer roll down the third ramp section 62 thereby blocking further dispensing. Because of this angle $\alpha$ for the third ramp section 62, proper alignment of the cans can be maintained. As will be discussed below, this alignment is subsequently used in forming a package with the cans or articles properly aligned.

As previously noted, the openable end of the can will fall from one of the storage columns onto either ramp section 58 or 60. Then these cans will slide downwardly onto the third ramp section 62. The can will then roll downwardly. This rolling is in a direction which extends out of the page in FIG. 4A. When the can rolls in such a manner, it will be delivered through an opening 64 in door 12 as seen in FIG. 1. This third ramp section 62 has a stop 66 with an adjacent pocket or step for stopping the rolling cans. The cans or other vended articles can then be picked up from this area of the third ramp section 62 for subsequent processing as will be described later.

In FIG. 4A, it should be noted that the height of the column 38 is slightly greater than that of column 50. This is because each of the columns are successively reduced in height from the left to the right in FIG. 4A in order to accommodate the underlying ramp sections 58, 60. Of course, if articles are to be fed from the holding areas 54 by means other than a gravity feed, the columns could be made all the same size.

Figure 4B:
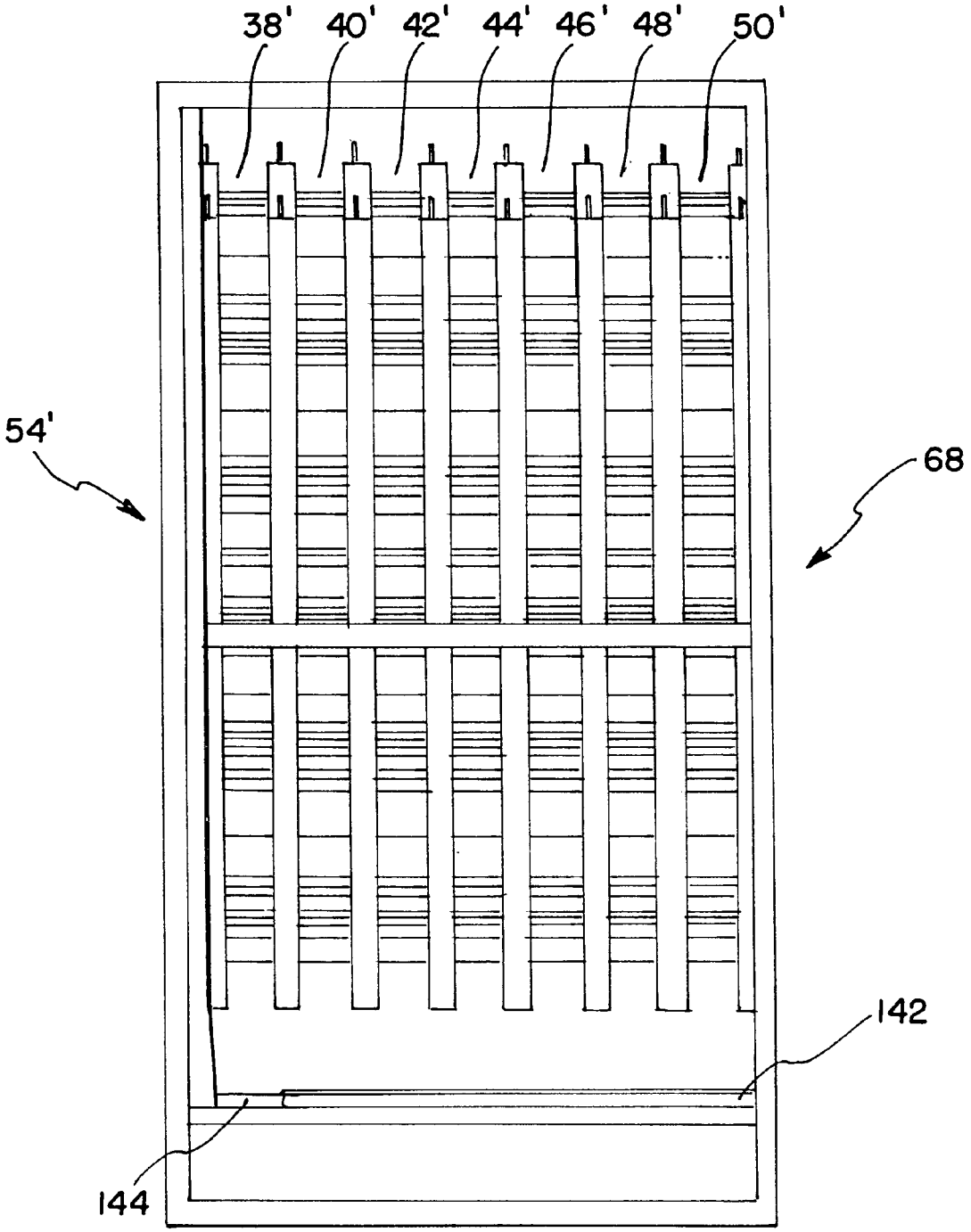
FIG. 4B is a front view of a second embodiment of the interior of the first embodiment of the vending machine showing the storage area.

A second embodiment of the interior of the vending machine showing the storage area is illustrated in FIG. 4B. In this example, conveyors 142 and 144 are provided in place of the ramp sections 58 and 60. While not shown, a rear conveyor is also provided in place of the third ramp section 62. Of course other than a belt or chain conveyor 142, 144, movable baskets, a robotic arm or any other suitable arrangement could be provided for moving the articles from the holding areas 54' to the packaging area.

In this second embodiment, it is contemplated that selected cans or other containers will drop from one of the forward columns 38', 40', 42', 44', 46', 48' or 50' or from one of the rear columns onto either the forward conveyor 142 or the rear conveyor. The conveyor receiving the can will then move the can to the conveyor 144 which will discharge the can through the opening 64. Instead of using conveyor 144, the conveyor 142 could feed articles to a gravity feed ramp such as ramp section 62. Also, instead of being on the left end of conveyor 142 as seen in FIG. 4B, the conveyor 144 or ramp section 62 could of course be on the right end of this conveyor 142. Alternatively, a central conveyor or ramp section could be used in place of conveyor 144 with conveyors on each side thereof feeding cans to this central conveyor or ramp section. Moreover, rather than using a forward conveyor 142 and a separate rear conveyor, a single conveyor could also be used. Of course, if there were more than the forward columns 38 and rear, second columns 52, additional conveyors could be used.

It should be noted that in FIG. 4B, that the bottom of the columns 38', 40', 42', 44', 46', 48' and 50' are aligned along the bottom. Because gravity-feed inclined ramp sections 58, 60 and 62 are not exclusively used in this second embodiment, the height of each successive column need not be reduced as in the first embodiment. Therefore, more space can be provided within the columns and more space within the interior of the holding area 54' can be utilized.

While seven forward columns and seven rearward columns are indicated in FIGS. 4A, 4B and 5, any suitable number of columns could be provided. Moreover, while the left-handmost column 38 drops cans directly onto the third ramp section 62 in FIGS. 4A and 5 and onto the conveyor 144 in FIG. 4B, the first and second ramp sections 58, 60 could be extended in the first embodiment or the conveyors 142 could be extended in the second embodiment such that the cans land on these sections or conveyors instead of the third ramp section 62 or conveyor 142.

Also, rather than using a serpentine arrangement for storage of articles as indicated in FIG. 5, any suitable storage arrangement could be provided. For example, a stack vendor could be used. Also, the number of columns and number of rows of columns could of course be varied.

The various columns housing the beverages as well as the ramp 56 and conveyors 142, 144 are all provided within the storage area 68. A plurality of cans 70 are held in the plurality of holding areas 54, 54' of storage area 68. Each of the different columns could have a different brand of article. For more frequently vended articles, more than one column could be used if so desired. While cans 70 are shown, it is again emphasized that the present invention could be used to vend beverages and other containers such as bottles or to vend any other product.

Figure 2:
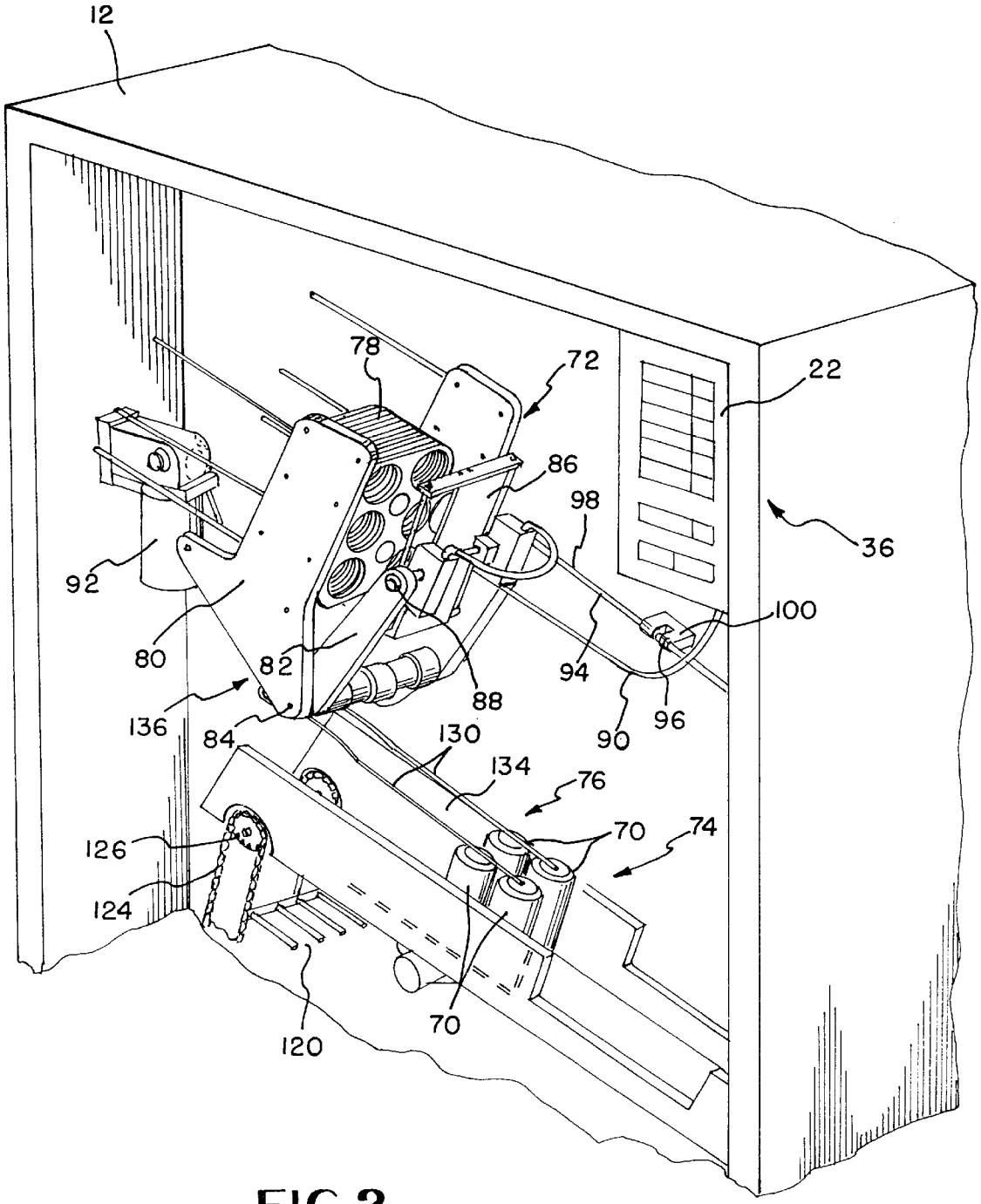
FIG. 2 is an enlarged perspective view of a portion of the first embodiment of the vending machine of the present invention with the display panel removed.

Turning now to FIG. 2, the packer 72 and discharger 74 of the present invention will be described. This packer 72 and discharger 74 are located in the door 12 of the vending machine 10. It is contemplated that instead of using the pivotable door 12 on the vending machine 10, that the front of the vending machine 10 could, in fact, be a one-piece or unitary structure. In other words, the door 12 would not be at the front of the vending machine body 14. Another access opening could be provided on the top, side or back of the vending machine, for example. However, because of conventional arrangements and for ease of access to the interior of the vending machine, it is contemplated that a pivotable door 12 will be used.

The packer 72 of the present invention will pack a plurality of articles in the packaging area 76 into a single, unitary package. As has been noted, six-packs are being described as being formed in the present vending machine 10. Six individual cans will be moved to packaging area 76 in order to have a carrier 78 placed thereon. Placement of a carrier onto six cans will form the unitary package or six-pack. A plurality of carriers 78 are shown in the supply holder 80 and these carriers 78 will be described in more detail below. An arm 82 is pivotably mounted on the supply holder 80 at pivot 84. This arm 82 has a right-hand and left-hand section with a vacuum gripper head 86 being mounted opposite the pivot 84. A pivot 88 for the gripper head 86 is provided so that the head 86 can move relative to the arm 82.

Air line 90 provides suction to the gripper head 86. A suitable suction source can be attached to the opposite end of this air line 90. The air line 90 is a flexible hose, for example, and is therefore movable with the gripper head 86. While a vacuum gripper head 86 has been described, it should be noted that any suitable gripper could be provided for moving the carriers 78 from the supply holder 80 to the packaging area 76. Apart from moving the carrier 78 to packaging area 76, the packer 72 also places the carrier 78 onto the articles in the packaging area 76 in order to form the package.

A motor 92 is provided for pivoting the arm 82 about pivot 84. A linkage arrangement 94 is pivotably mounted to the door 12 at point 96. The linkage arrangement 94 includes a rod 98 which will slide in a holder 100. The opposite end of this rod 98 is pivotably fixed to the gripper head 86. As the arm 82 pivots about point 84, the rod 98 will slide in holder 100. The arm 82 will pivot as indicated from FIG. 3A through FIG. 3H. The arm 82 moves from an outward position to a position in FIG. 3B where the gripper head 86 engages the lowermost carrier 78 in the supply holder 80. Then the arm 82 will move to the position of FIG. 3C, FIG. 3D to FIG. 3E. It should be noted that the gripper head 86 pivots from a generally vertical orientation to a generally horizontal orientation during this arm movement. While the gripper head 86 is not exactly vertical in the position of FIG. 3B and is not exactly horizontal in the position of FIG. 3F, for example, these positions are nonetheless referred to as vertical and horizontal orientations because the head is generally either vertical or horizontal.

Figure 3B:
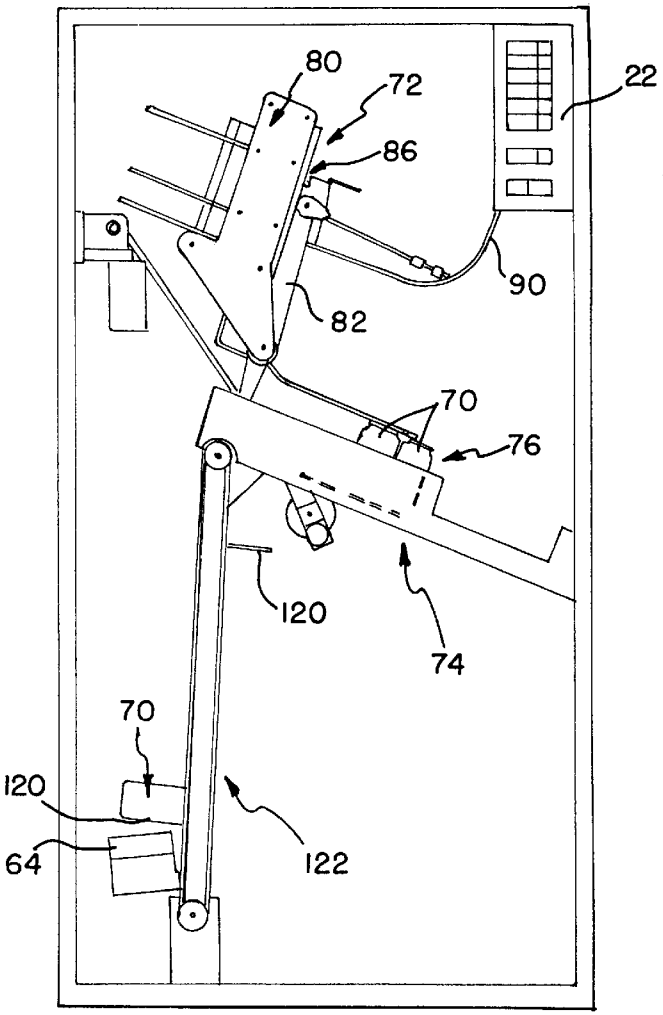
FIG. 3B is a view similar to FIG. 3A showing a set of articles being fed to the packaging area by an elevator.
Figure 3A:
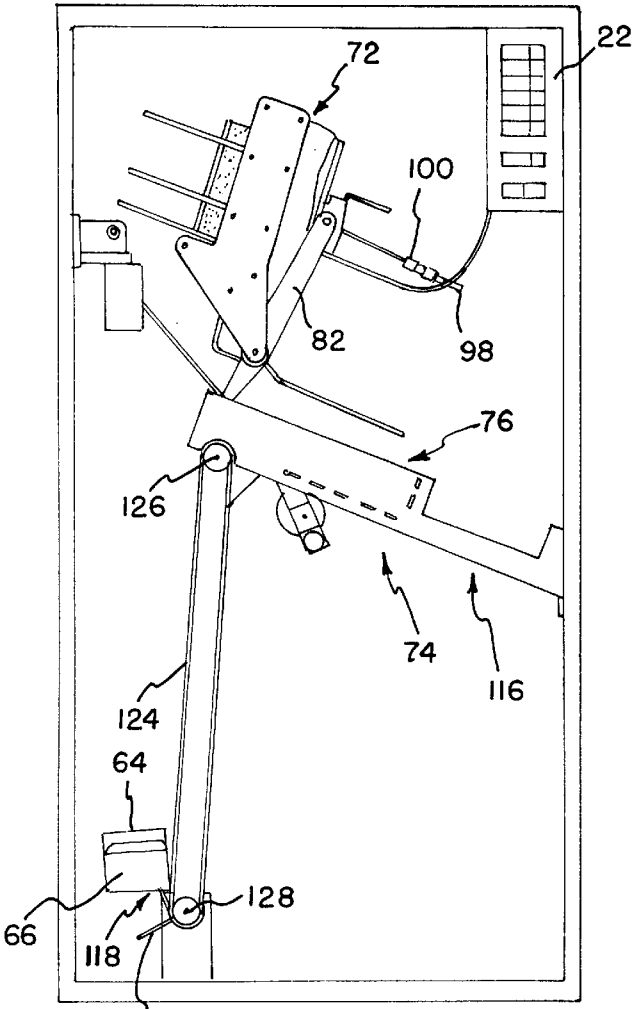
FIG. 3A is a view of the interior of the door of the first embodiment of the vending machine of the present invention prior to a packaging operation.
Figure 3D:
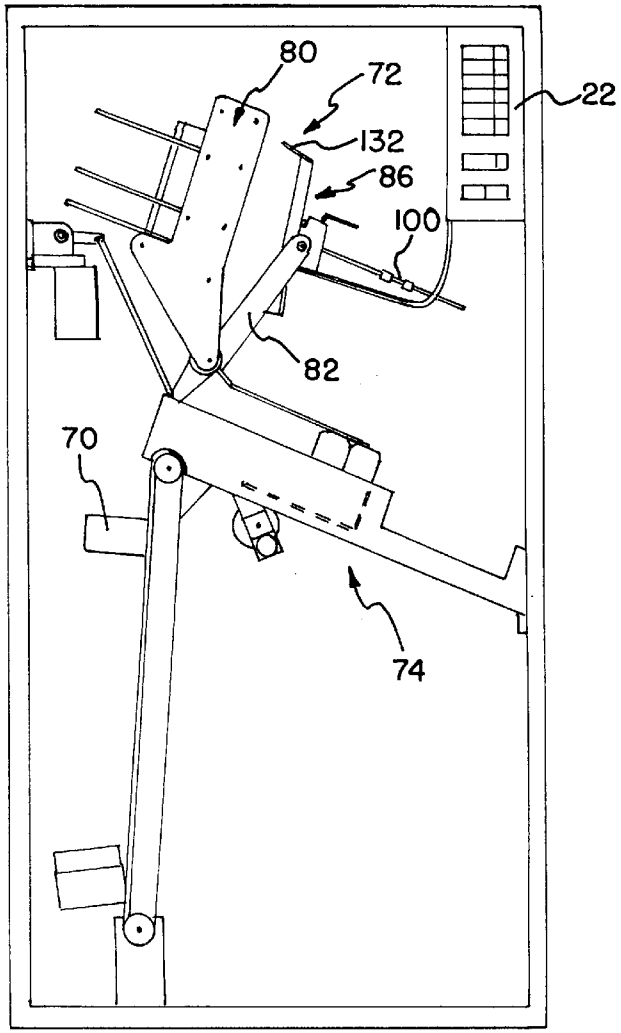
FIG. 3D is a view similar to FIG. 3C with the set of articles near the top of the elevator and just after activation of the packer.
Figure 3C:
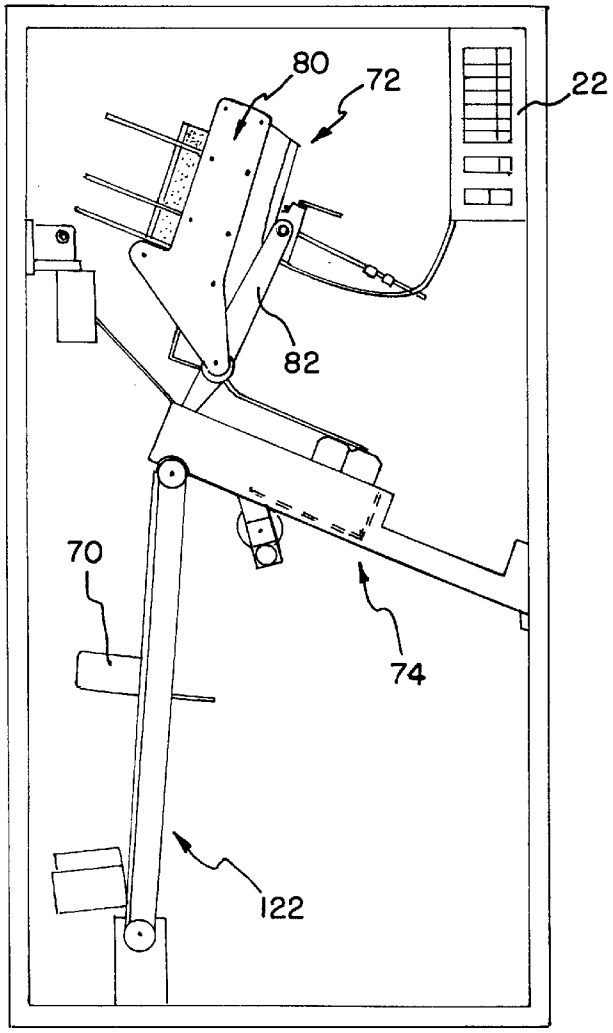
FIG. 3C is a view similar to FIG. 3B but with the set of articles slightly elevated on the elevator.
Figure 3F:
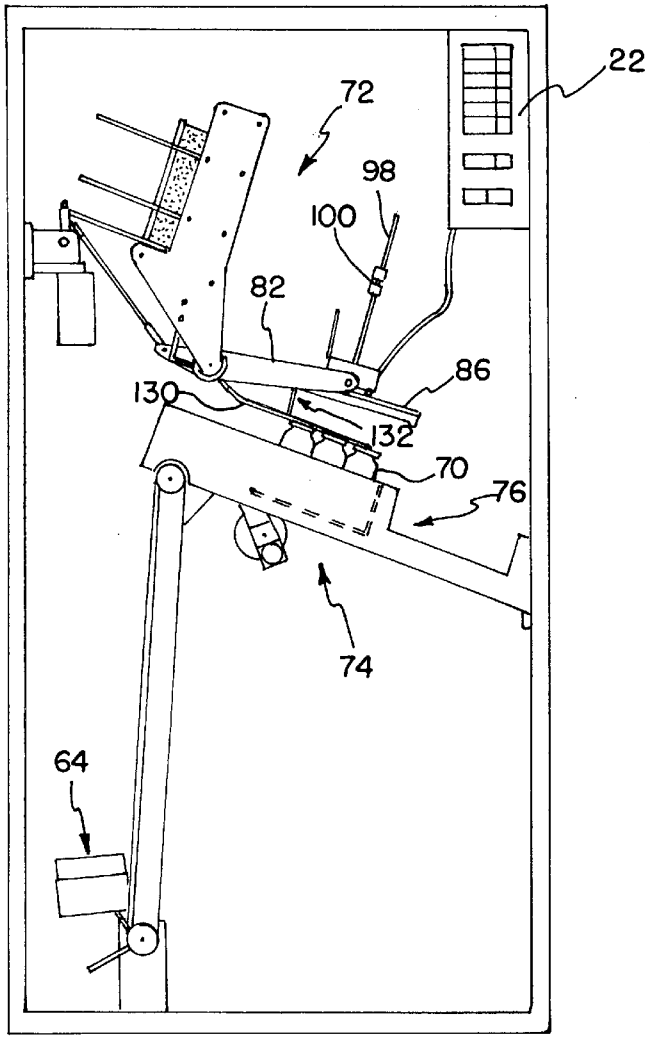
FIG. 3F is a view similar to FIG. 3E showing three sets of articles in the packaging area with the packer about to insert a carrier thereon.
Figure 3E:
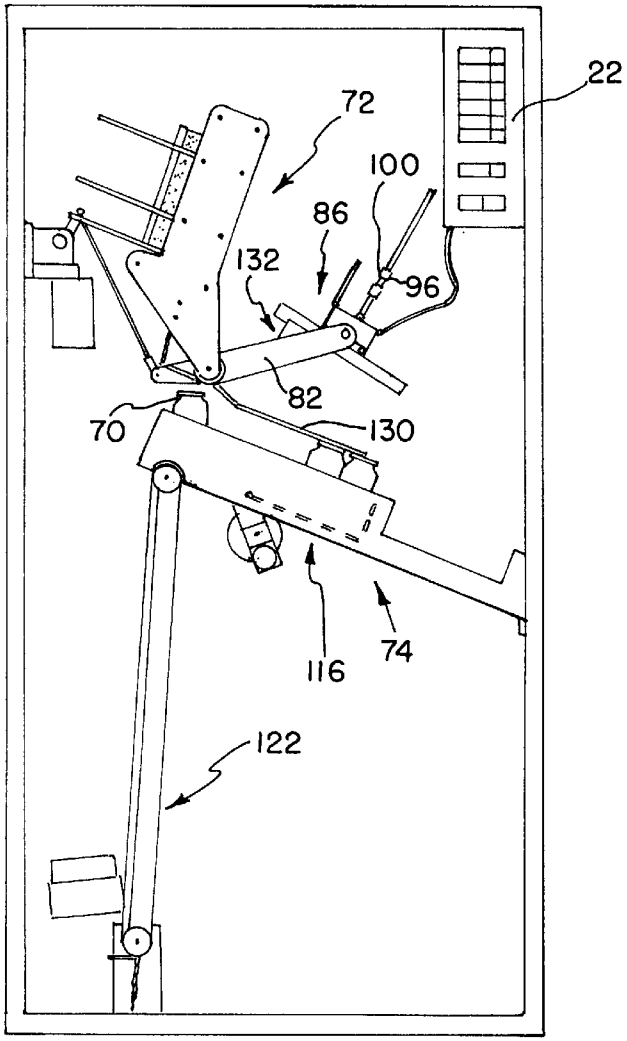
FIG. 3E is a view similar to FIG. 3D showing the set of articles discharged from the elevator and showing further movement of the packer.

As seen between FIG. 3A to FIG. 3D, the rod 98 slides in the holder 100. When moving from the position of FIG. 3D to the position of FIG. 3E, the holder 100 is pivoted at 96. This pivoting motion accommodates the movement of the arm 82. As the arm 82 continues to pivot from FIG. 3E to FIG. 3F, the rod 98 then slides in an opposite direction in the holder 100. This movement basically lowers the gripper head 86 towards the articles in the packaging area 76. The gripper head will have a carrier 78 which it places on the articles as shown in FIG. 3G. The gripper head 86 holds the carrier 78 in a bowed position from the supply holder 80 to the packaging area 86. When the carrier 78 engages the articles while being held by the gripper 86, the gripper head 86 will flex. This will serve to flatten the carrier 78. Because the carrier 78 is initially bowed, a central portion thereof will first contact the cans in the packaging area 76 as will now be described with reference to FIGS. 6 through 8.

Figure 6:
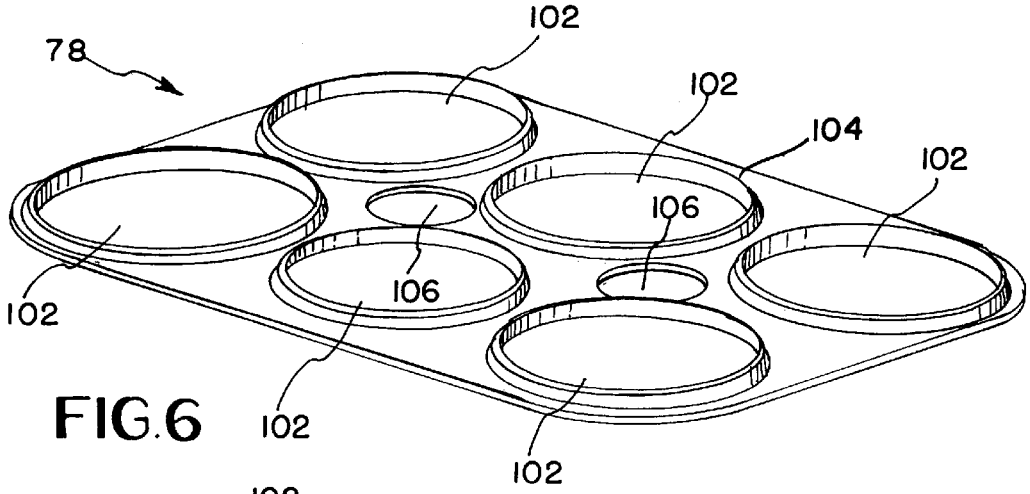
FIG. 6 is a perspective view of a carrier used in the present invention.

In FIG. 6, the carrier 78 is made from a flexible, plastic material. However, the carrier is sufficiently rigid in order to hold the articles such as the cans in a satisfactory manner. Because a six-pack is being formed, a carrier 78 with six openings 102 is shown in the Figures. Of course, if another size of package were to be produced, such as a twelve-pack, for example, a different sized carrier with different number of openings could be used. Also, instead of using a carrier 78 as described, any suitable banding arrangement could be provided for combining the articles in the packaging area 76 into a package. Moreover, the articles could be formed into a package by being glued together or by being enclosed in a cardboard wrapper.

The openings 102 of the carrier 78 are defined by raised walls 104. Each of the openings 102 is encircled by the annular wall 104 to thereby define the openings 102. While the individual walls are shown as completely encircling the formed opening 102, this wall could be broken if the structure or material of the wall 104 were sufficiently rigid to hold an inserted can in place.

Figure 8:
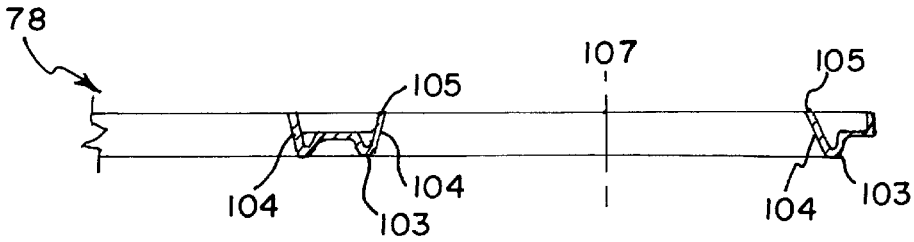
FIG. 8 is an enlarged, partial sectional view of the carrier taken along line VIII—VIII of FIG. 7.

The wall 104 is sloped as indicated in FIG. 8. In particular, a first surface 103 is closer to a center 107 of the opening 102 than a second surface 105. Therefore, with respect to the direction of can insertion, the walls 104 slope inwardly. This slope aids in aligning a can with the opening 102 into which it is to be inserted. The walls 104 therefore act as camming surfaces for aligning the cans. It should be noted that the while FIG. 8 shows the second surface above the first surface, the carrier 78 could, of course, be flipped over or placed in any other suitable orientation. Nonetheless, the sloping wall 104 results in the openings 102 having a funnel shape.

Figure 7:
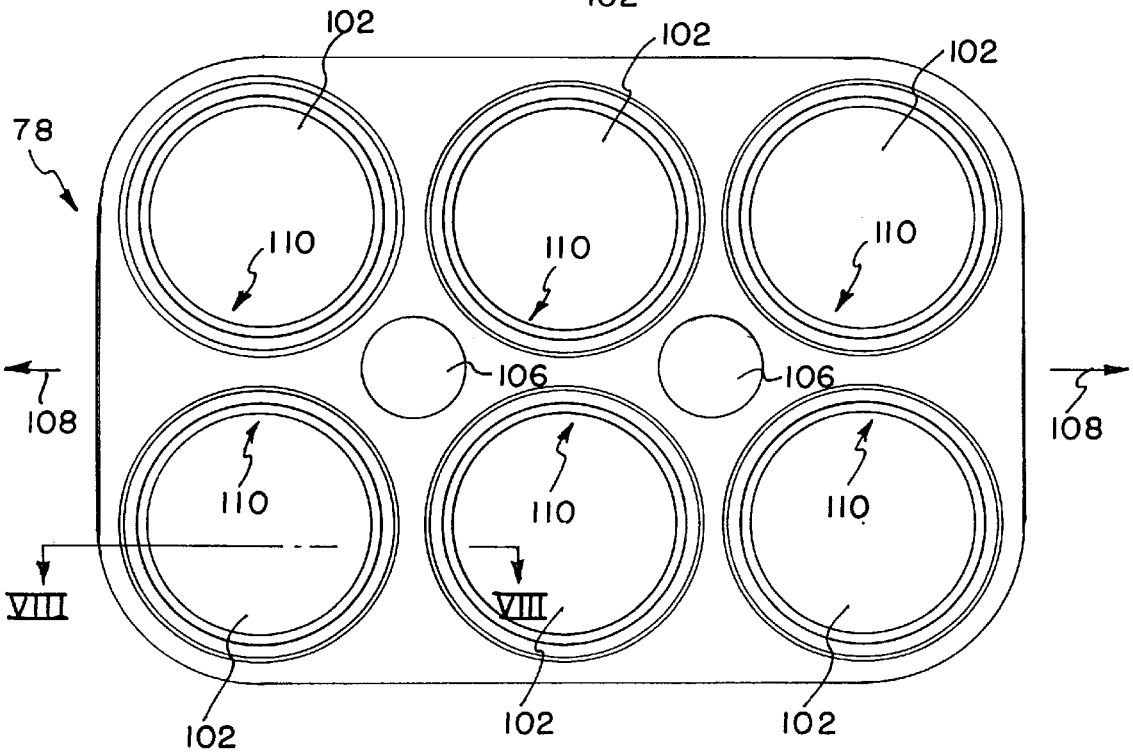
FIG. 7 is a top plan view of the carrier of FIG. 6.

Two separate openings 106 are also located on the carrier 78. These openings 106 are centrally positioned and are sized to receive a consumer's fingers which can be inserted into these openings 106 for carrying the formed six-pack in a known manner. A central longitudinal axis 108 is indicated in FIG. 7 for the carrier 78. The gripper head 86 will initially bow the carrier along this axis. In other words, the central portion along the axis 108 will be sticking outwardly away from the gripper head 86. The inner portion 110 of the openings 102 towards the central axis will therefore first engage the tops of the cans 70 in the packaging area 76. This bowed configuration will help to place the carrier 78 onto the cans.

This inner portion 110 of each of the openings 102 will be the area of the wall which first engages the cans 70 when the carrier 78 comes into engagement therewith in the packaging area 76. The gripper head 86 will continue to move towards the cans after this initial engagement with the carrier. This will force the remainder of the walls 104 of each of the openings 102 around the cans 70 which are aligned thereunder. During this operation, the gripper head 86 flexes to move the carrier 78 from a bowed confirmation to a flat configuration. In this manner, the carrier 78 can be placed on the cans to form a six-pack with minimum pressure. The funnel shape of the sloping walls 104 also helps to center or align the cans 70 or other articles with the openings 102 as noted above. Instead of snapping the carrier 78 onto the cans in this described manner, the carrier 78 could be in a flat orientation and pressed directly onto the cans 70. Such an arrangement, however, would require 150 lbs. of force, for example. With the present snap on arrangement, on the other hand, considerably less force is used. Therefore, the packer 72 of the present invention is simplified.

Figure 3H:
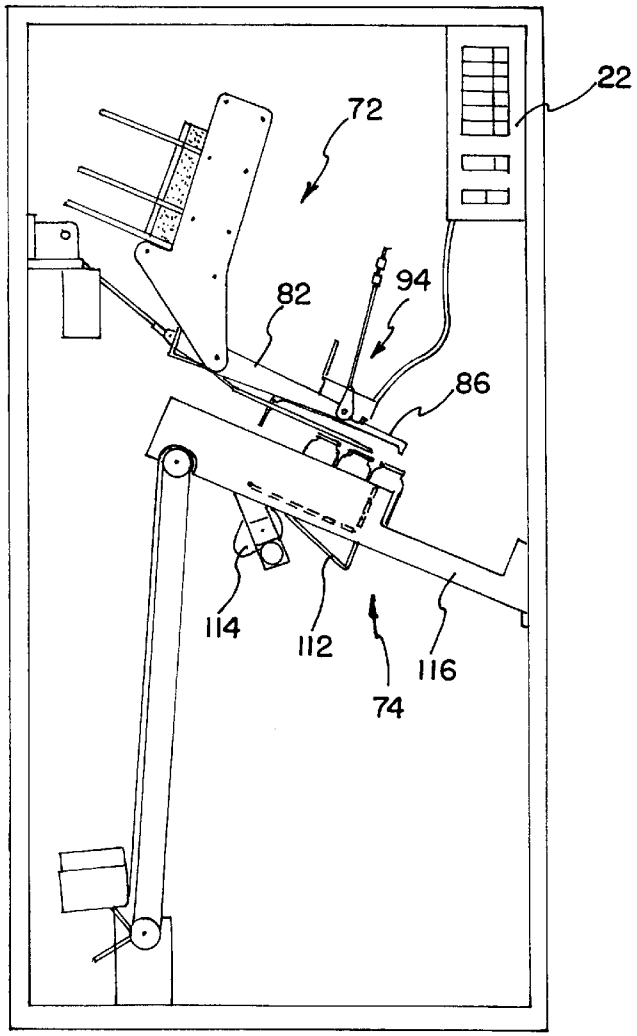
FIG. 3H is a view similar to FIG. 3G but showing the package being discharged.
Figure 3G:
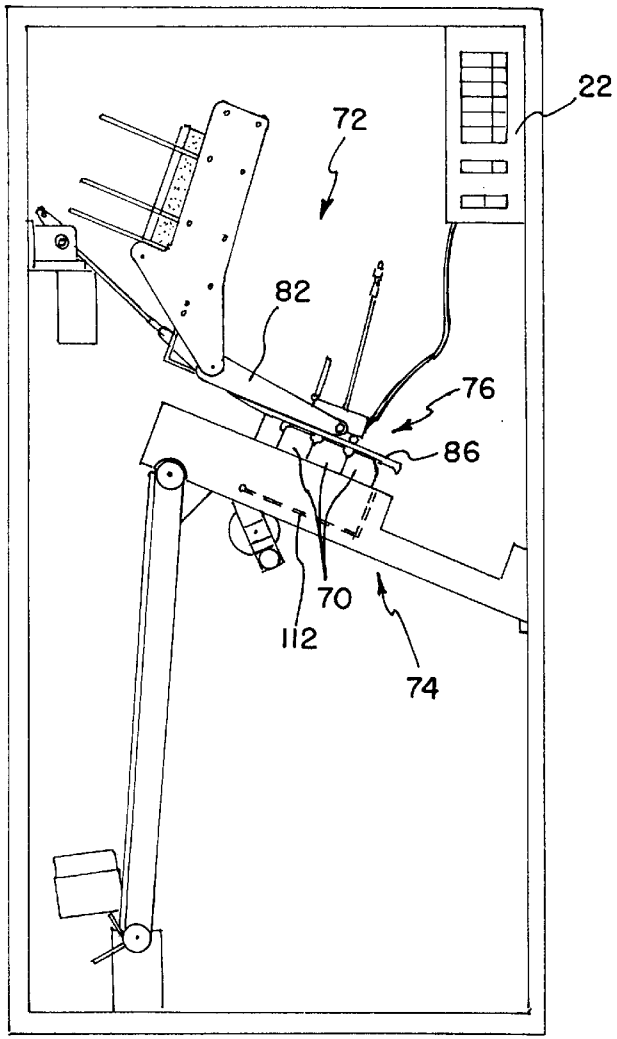
FIG. 3G is a view similar to FIG. 3F but showing the packer inserting the carrier on the plurality of articles to form a package.

After the carrier 78 is placed on the cans 70 to form a package, i.e., a six-pack, the gripper head 86 is moved away from the cans as indicated in FIG. 3H. Beneath the packaging area 76 is a gate 112. The gate 112 is moved from the closed position in FIG. 3G to an open position in FIG. 3H by a motor 114. This motor 114 is not actuated until the carrier 78 has been placed on the cans in order to form a package and the gripper head 86 has been moved out of the way. When the gate 112 is moved to the open position, the cans will slide by gravity along chute 116 to an area adjacent the port 20. The consumer can then reach through the port 20 and withdraw the formed six-pack. It should be noted that when the gate 112 is in the closed position as shown in FIG. 3G, a consumer will be prevented from reaching through the port 20 into the packaging area 76. Other suitable gates could also be incorporated in order to ensure that the packaging area cannot be improperly accessed through the port 20.

It has previously been discussed that articles are fed from the storage area 68 in the vending machine 10 through an opening 64 as seen in FIGS. 1 and 3A. In this area adjacent stop 66, the third ramp section 62 has an opening or plurality of openings 118. This opening is sufficiently small to prevent cans or other articles which are resting on the third ramp section 62 from falling therethrough. However, a shelf 120 of an elevator 122 can pass through this opening 118. This shelf 120 can have a plurality of forks which are mounted on the elevator 122 as seen in FIG. 2. The shelf 120 will move through the opening 118 in order to pick up articles such as cans 70 resting at the end of the third ramp section 62.

If cans or other articles are fed by conveyor 144 of the second embodiment, then a mechanism can be provided on the elevator 122 to pick the cans off of the conveyor 144. Alternatively, the conveyor 144 can feed cans to a shelf or platform adjacent the elevator 122 and this shelf or platform can have the openings 118 through which the shelf 120 of the elevator 122 moves.

In a six-pack, two rows of cans are provided. Therefore, during operation of the present invention, two cans 70 will move from the storage area to the end of the third ramp section 62 or end of conveyor 144. At this ramp section end or conveyor end with or without the platform or shelf, a recessed pocket or step can be provided.

This recessed pocket or step will receive the cans or other articles and stop them from bouncing backward in an upstream direction. When the cans come to stop 66, there is a tendency for them to rebound and thereby increase cycle time while waiting for the cans to settle. This recessed pocket or step catches the cans to prevent this rebound and therefore allows them to settle quickly. Accordingly, operation of the elevator 122 need not be unnecessarily delayed while waiting for the cans to settle. It is contemplated that if two cans are fed to the elevator before this elevator is actuated, then the width of the pocket or step would be slightly greater than the diameter of two cans.

Both of these cans in front of the elevator 122 will then be simultaneously picked up by the shelf 120 and raised by elevator 122. While only one can 70 is visible in FIG. 3B, it should be noted that a second can is located behind the shown can. Either the same type of article or different types of articles can be vended. For example, the same brand of beverage or different brands of beverages can form the pair of cans fed to the elevator 122. The elevator 122 includes at least one endless element 124. Of course, this endless element 124 can be a pair of endless chains or belts or any other suitable number of chains or belts could be used. Many other types of lifting arrangements which are known could of course be used.

Two shelves 120 are permanently mounted on the endless element 124. Upper and lower pulleys 126, 128, respectively are provided around which the endless chain or belt element 124 rotates. A motor (not shown) is provided for driving this elevator 122. Of course, any of the afore-described motors 92 or 114 could also be used for driving the elevator if so desired. This motor for the elevator 122 is merely a conventional motor.

In FIG. 3A, the vending machine 10 is in a standby position. When a consumer activates the selection panel 22 to choose an appropriate number of articles and depresses the start button 32, an operation cycle of the vending machine 10 will begin. A first and a second can are sequentially released from the storage area 68. They will roll down the ramp 56 to the end of the third ramp section 62 or be conveyed and discharged by conveyor 144. The elevator 122 will then be activated in order to lift the pair of cans on shelf 120. As the elevator 122 moves around the upper pulley 126, the cans will be discharged from the shelf 120 onto the chute 116 which leads to the packaging area 76.

In FIG. 3B, this process has been repeated twice such that two pairs of cans 70 are shown in the packing area 76 (see also FIG. 2). A third pair of cans 70 is being lifted by the elevator 122 in FIG. 3B. This elevator 122 in FIG. 3B has two shelves 120 mounted thereon. Of course, any suitable number of shelves could be used. It should be noted that the second shelf in FIG. 3A is hidden behind a guide wall in the packaging area 76.

In FIG. 3C, the third pair of cans 70 continues to be lifted by the elevator 122. Also, the gripper head 86 now begins to move away from the supply holder 80. In FIG. 3D, the gripper head 86 continues to move away from the supply holder 80 and the third pair of cans 70 is almost at the top of the elevator 122. In FIG. 3E, the third pair of cans 70 has moved from the elevator 122 onto the chute 116. A pair of guides 130 are shown in FIGS. 2 and 3E–F. These guides 130 help to catch the cans as they are discharged from the elevator 122. The guides 130 will prevent the cans 70 from flying from the elevator or from tipping over when being moved onto the chute 116. As the elevator 122 reaches the upper pulley 126, its speed is slowed to prevent the cans 70 from being thrown forward as they move onto chute 116.

As has been previously noted, the cans are fed with their ends having the openings facing the left-hand wall of the vending machine body 14 in FIG. 4A. These cans roll down the third ramp section 62 and are then picked up by the elevator such that their ends with the openings are always facing upwardly. When a carrier 78 is placed over the plurality of cans, all cans will therefore be in a proper orientation with their ends having the openings facing upwardly. This same correct orientation of cans is provided with the conveyors 142, 144 used in the second embodiment of FIG. 4B.

Instead of being aligned with all can tops facing upwardly, other variations are possible. The gripper head or other device could insert the carrier onto the bottom of the six-pack. Then, the cans could be stored in the holding areas 54, 54' such that they are eventually fed to the packaging area with their ends having the openings facing downwardly. Other constructions are also possible.

While not shown in FIG. 2, the forward end of the gripper head 86 has a camming surface 132. This camming surface can be seen in FIGS. 3D and 3E, for example. The camming surface 132 can generally have a V-shape or a U-shape. This camming surface 132 is inserted in the space 134 between the guides 130. This space 134 is seen in FIG. 2, for example. When the camming surface 132 is inserted in this space, it will engage the guides 130 and move them away from one another. The guides pivot about their forward ends 136 where they are mounted on the supply holder 80. As seen in FIG. 2, the guides 130 normally overlie the upper portion of the cans 70. This positioning prevents the cans from tipping over when being discharged from the shelf 120 of the elevator 122. When the camming surface 132 is inserted in the space 134 to move the guides 130 away from another, the gripper head 86 can then move between the guides 130. This will provide unobstructed access to enable the gripper head 86 to bring the carrier 78 into engagement with the group of cans in the packaging area 76.

As seen in FIG. 3F, the camming surface 132 is inserted between the guides 130. Then in FIG. 3G, the gripper head 86 with the carrier can engage the cans 70 in the packaging area 76. The gripper head 86 will then move away from the cans. While the camming surface 132 is still engaged with the guides 130, the gate 112 could be opened. Alternatively, this gate 112 could be opened after the camming surface 132 is out of engagement with the guides 130 and they have returned to their original position. Because a carrier 78 has been inserted around the cans 70 to form a six-pack or other package, it is not necessary to have the guides 130 continue to guide the cans. The formed six-pack will not tip over as will happen with individual cans.

The elevator 122 with the ramp 56 or conveyor 144 forms a dispenser 138 of the present invention. Operation of this dispenser 138 can be viewed through the display panel 16 as indicated in FIG. 1. Also, operation of the packer 72, and discharger 74 can also be viewed. This display will help to generate consumer interest.

The vending machine 10 of the present invention includes the storage area 68 in the vending machine 10. The dispenser 138 includes the ramp 56 or conveyor 144 with the elevator 122. Articles are moved from the storage area 68 by the dispenser 138 to the packaging area 76. In this packaging area 76, the packer 72 can pack a plurality of articles into a single, unitary package. This discharger 74 will then remove this unitary package from the packaging area 76. The discharger 74 includes the chute 116 and the movable gate 112.

The present vending machine 10 provides for a method of packaging and vending a plurality of articles from a single machine. This method includes the steps of selecting a plurality of articles. Such selection can be made through the selection panel 22. The controller 36 will cause a group of selected articles in storage area 68 to be discharged onto the ramp 56 or conveyors 142, 144. The articles will then move along this ramp 56 or conveyors to the elevator 122 and then to the packaging area 76. All of this activity occurs within the vending machine 10. The plurality of articles are then combined into a package in the packaging area 76 by the packer 72. Finally, the formed package is then discharged by the discharger 74. This package can be removed through port 20 by the consumer.

While a separate port 20 has been shown downstream of the packaging area 76, it is possible that a port could be provided adjacent at the packaging area. For example, a door could be provided which prevents access to the packaging area 76 during formation of the six-pack. When the six-pack is completed, the door could then be opened and the consumer could directly withdraw the product.

Also, while an elevator 122 has been shown for lifting articles to the packer 72, such an elevator could be omitted. For example, a robotic arm or other driven conveyor arrangement could be provided for lifting the articles to the packaging area 76. Because the packaging area 76 is at a midportion of the vending machine 10, this results in the port 20 being at a convenient height for the user to withdraw the formed package.

Of course, the port 20 could be located towards the bottom of the machine and the entire elevator structure 122 could be omitted. The articles would simply be fed from the ramp 56 or conveyor 144 to the packaging area 76 without being lifted. The consumer could then remove the articles from a low port 20. Alternatively, the then formed package could be from at a low level within door 12 and then lifted from the packaging area to a raised convenient port. Many modifications are possible with the present invention.

Figure 9:
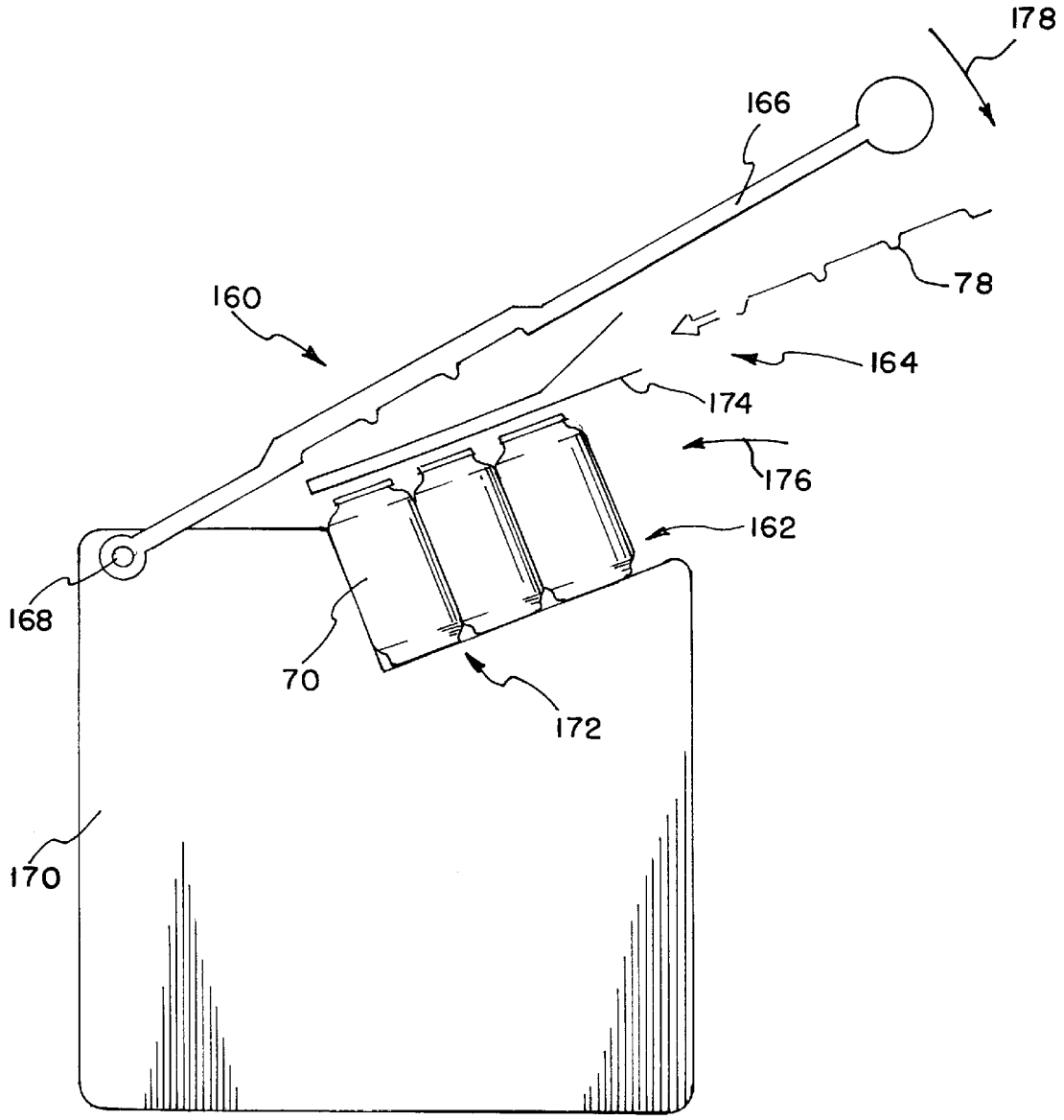
FIG. 9 is a side view of a second embodiment of the vending machine of the present invention.

Referring to FIG. 9, a second embodiment of a vending machine 160 is shown. As was noted above, the use of the term "vending machine" and "vendor" is not to imply that this machine must be coin operated. This second embodiment has a packaging area 162 and a packer 164. The packer includes a handle 166 pivotable about axis 168. The handle 166 is pivotably attached to base 170.

In the base 170, the packaging area includes an inclined support 172 for receiving articles to be packaged. These articles can be cans 70 for beverages or other containers such as bottles. In fact, the principles of the present invention are applicable to a wide variety of products which are to be packaged and vended.

The cans 70 or other articles are placed on inclined support 172. A carrier 78 is then inserted into clips 174 or other holders provided on the vending machine 160. The carrier 78 and cans 70 are inserted generally in the direction indicated by arrow 176. The handle 166 is then pivoted downwardly as indicated by arrow 178. This action will detach the carrier from the clips 174 and place it on the cans 70 or other articles. Therefore, a consumer can select the desired articles and place them in the vending machine 160 whereafter the consumer can package the plurality of articles into a unitary package.

Rather than using a pivotable handle 166, a reciprocating handle or other suitable device can be used to band or combine the articles into the unitary package. After the package is formed, the consumer manually removes the pack from the vending machine 160. Of course, some automated ejector could be provided.

In the example of FIG. 9, a six-pack is formed. It should be appreciated, however, that eight-packs, twelve-packs or any other suitable number of articles can be combined into a package in the present invention. In fact, only two articles could be combined if so desired. Moreover, a single machine 160 could vend more than one size package.

Again, it is stressed while the present invention has been discussed as forming six-packs, any suitable sized package can be formed. This includes eight-packs, twelve-packs, twenty-four packs or even just two articles packaged together.

Also, while a particular plastic carrier 78 has been described, any suitable arrangement can be used for combining the selected articles into a package. The present invention nonetheless empowers consumers to form a package as they desire. In other words, the consumer can select the suitable types of articles to be included in the package. Moreover, the present invention has been discussed as sequentially forming different six-packs, it is possible that different sized packages could be formed with the present invention. For example, the packer 72 could be provided with different sized carriers for forming six-packs, eight-packs, twelve-packs, etc. within the same vending machine 10. Therefore, the present vending machine 10 enables different varieties to be vended as well as different quantities of articles within a package to be vended.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A vending machine for packaging a plurality of articles into a unitary package comprising:

a housing for the vending machine;

a packaging area for receiving a plurality of articles;

a storage area for a group of articles, the storage area being stationarily mounted within the vending machine housing;

a selection device for receiving a selection of a plurality of articles to be packed into a unitary package;

a packaging device in operative communication with the selection device for automatically packing the selected plurality of articles in the packaging area into the unitary package based on the selection of the plurality of articles received by the selection device; and wherein the packaging area, the packaging device and the storage area are within the housing of the vending machine, and the unitary package is vended from within the housing of the vending machine to the consumer.

2. The vending machine as recited in claim 1, further comprising:

a dispenser for moving a plurality of articles from the storage area to the packaging area; and a discharger for removal of the unitary package of the plurality of articles from the vending machine, the dispenser and the discharger being within the housing of the vending machine.

3. The vending machine as recited in claim 2, further comprising a plurality of selection buttons operable by a consumer, the buttons being operated to select types of articles to be moved by the dispenser from the storage area to the packaging device.

4. The vending machine as recited in claim 3, wherein for each operation cycle of selectively vending a unitary package to a consumer, a selected number of articles are moved by the dispenser from the storage area to the packaging area and are packaged by the packaging device into a unitary package, articles in a package being a same type or a different type.

5. The vending machine as recited in claim 4, wherein the articles are beverage containers and wherein types of articles are brands of beverages, the packaging device placing a carrier around a plurality of articles in the packaging area to form the unitary package.

6. The vending machine as recited in claim 3, wherein for each operation cycle of selectively vending a unitary package to a consumer, six articles are selectable from the storage area and packaged in the packaging device and wherein at least some of the articles in the unitary package are a different type.

7. The vending machine as recited in claim 2, wherein the dispenser comprises ramp provided adjacent the storage area and an elevator at an end of the ramp, articles being moved from the storage area on the ramp to the elevator, the elevator being at a downstream end of the ramp and having a shelf for raising articles to the packaging area.

8. The vending machine as recited in claim 7, wherein the elevator comprises at least one endless element with a shelf attached thereon, the endless element lifting and lowering the shelf and the shelf being positioned to receive articles from the ramp when in a receipt position and the shelf discharging articles to the packaging area when in the discharge position, the receipt position being beneath the discharge position.

9. The vending machine as recited in claim 8, wherein the at least one endless element is a chain or belt which is rotatable driven to raise and lower the shelf and wherein the ramp has an opening therein through which the shelf is moved to pick up an article from the receipt position.

10. The vending machine as recited in claim 7, wherein the storage area has a plurality of holding areas and wherein the ramp extends beneath each of the holding areas, articles being dropped from selected holding areas onto the ramp and moving by gravity to a position adjacent the elevator.

11. The vending machine as recited in claim 10, wherein the ramp has at least three sections, a first section of the ramp being beneath half of the holding areas, a second section of the ramp being beneath another half of the holding area, a third section of the ramp interconnecting the first and second sections and extending to the position adjacent the elevator, the third section of the ramp being generally perpendicular to the first and second sections and all of the ramp sections extending downwardly.

12. The vending machine as recited in claim 2, wherein the dispenser comprises at least one conveyor provided adjacent the storage area, the at least one conveyor moves the plurality of articles toward the packaging area.

13. The vending machine as recited in claim 2, wherein the packaging device comprises a supply holder for a plurality of carriers an a movable arm for placing a carrier from the supply holder onto the plurality of articles in the packaging area.

14. The vending machine as recited in claim 13, wherein the arm is pivotable about a generally horizontal axis and includes a vacuum gripper head, the vacuum gripper head picking a carrier from the supply holder, the arm being pivotable from a position adjacent the supply holder to a position adjacent the packaging area, the gripper head being pivotally mounted on the arm such that the gripper head is movable relative to the arm.

15. The vending machine as recited in claim 14, wherein the gripper head is pivotable from a generally vertical orientation when the arm is adjacent the supply holder to a generally horizontal orientation when the arm is adjacent the packaging area.

16. The vending machine as recited in claim 14, further comprising a pair of guides extending from the supply holder to a position over the packaging area, the guides being cammed away from one another by the gripper head when the arm is moved adjacent the packaging area.

17. The vending machine as recited in claim 14, further comprising a port in the housing of the vending machine for withdrawal of a package from the vending machine, the discharger having a chute and a movable gate, the chute being adjacent the packaging area and the gate being movable to an open position for gravity feed of a package from the packaging area along the chute to the port in the vending machine.

18. The vending machine as recited in claim 2, further comprising a port in the housing of the vending machine for withdrawal of a package from the vending machine, the discharger having a chute and a movable gate, the chute being adjacent the packaging area and the gate being movable to an open position for gravity feed of a package from the packaging area along the chute to the port in the vending machine.

19. The vending machine as recited in claim 18, wherein the gate prevents access to the packaging area from the port when the gate is in the closed position.

20. The vending machine as recited in claim 2, further comprising:

a door on a front of the vending machine, the door being movable between an open and a closed position, the storage area being accessible when the door is in the open position; and a display panel on the door of the vending machine, at least one of the dispenser, packaging device and discharger being visible through the display panel when the door is in the closed position.

21. The vending machine as recited in claim 1, wherein the packaging device comprises a pivotable arm.

22. The vending machine as recited in claim 1, wherein a plurality of articles are packed in the packaging device for at least one cycle of operation of the vending machine and wherein during at least one cycle of operation of the vending machine, only one article is received in the packaging area such that the vending machine dispenses both one article and a plurality of articles.

23. The vending machine as recited in claim 1, further comprising:

a first ramp section for receiving selected articles from the storage area;

a discharge ramp section for receiving the selected articles from the first ramp section, the first and discharge ramp sections being generally perpendicular; and an elevator for receiving the selected articles from the discharge ramp section and for discharging articles to the packaging area.

24. The vending machine as recited in claim 23, wherein more than one selected article is positionable on the elevator such that plural selected articles can be simultaneously handled by the elevator.

25. The vending machine as recited in claim 1, wherein the packaging device packages the plurality of articles such that the articles are stationarily held within and relative to the unitary package.

26. The vending machine as recited in claim 1, wherein the selection device is displayed on an external surface of the housing.

27. The vending machine as recited in claim 1, wherein the plurality of articles comprise a plurality of different types of containers and the selection device comprises a plurality of buttons for sequentially receiving a series of selections of the plurality of different types of containers to be packaged into a selected unitary package.

28. The vending machine as recited in claim 1, wherein the plurality of articles comprises six different types of beverages and the selection device comprises a button display for receiving a selection of six different types of beverages to be packed into a single unitary package by the packaging device.

29. A method of packaging a plurality of articles into a package and vending the package from a vending machine to a consumer, the vending machine having a housing and the method comprising the steps of:

storing a group of articles in a storage area within the vending machine housing, the storage area being stationarily mounted within the vending machine housing;

receiving a selection of a plurality of articles from the stored group of articles;

grouping the selected plurality of articles in a packaging area within the vending machine housing;

packing together each of the selected plurality of articles in the packaging area into a package in accordance with the selection of the plurality of articles from the stored group of articles, the packing occurring within the vending machine housing;

stationarily holding the articles within and relative to the package, the articles being held stationarily by the package; and vending the package from within the housing of the vending machine to the consumer.

30. The method of packaging and vending as recited in claim 29, further comprising the steps of:

storing the selected plurality of articles within the vending machine housing during the step of receiving a selection of the plurality of articles from the stored group of articles; and discharging the package with the selected plurality of articles from the vending machine housing.

31. The method of packaging and vending as recited in claim 30, wherein a pivotable arm with a vacuum gripper head and a supply holder for a plurality of carriers is provided at the packaging area in the vending machine and wherein the step of packaging further comprises the steps of:

pivoting the arm between the supply holder and the packaging area;

gripping a carrier from the supply holder with the vacuum gripper head when the arm is at the supply holder;

moving the carrier gripped by the vacuum gripper head to the packaging area during pivoting of the arm; and placing the carrier on a plurality of articles in the packaging area in the vending machine to thereby form the package.

32. The method of packaging and vending as recited in claim 31, wherein the arm is pivotable about a generally horizontal axis and wherein the step of combining further comprises pivoting the gripper head relative to the arm during the step of pivoting the arm.

33. The method of packaging and vending as recited in claim 31, wherein a pair of guides extends from the supply holder to a position over the packaging area, and wherein the method further comprises the step of camming the guides away from one another by the gripper head when the arm is moved to the packaging area.

34. The method of packaging and vending as recited in claim 30, wherein a port, a movable gate and a chute are provided in the vending machine, the chute extending from the packaging area to the port and the step of discharging comprising the steps of:

preventing discharge of articles from the packaging area with the gate during the step of combining;

opening the gate after the step of combining;

moving a package along the chute from the packaging area to the port after the gate is opened; and providing access to the package through the port after the package has moved to the port.

35. The method of packaging and vending as recited in claim 30, further comprising the step of displaying at least one of the steps of grouping, packing and discharging through a display panel on a front of the vending machine housing.

36. The method of packaging and vending as recited in claim 30, further comprising the step of dispensing a single article from the vending machine housing during at least one selected operation cycle.

37. The method of packaging and vending as recited in claim 29, further comprising the step of storing a plurality of different types of articles in the vending machine housing, the different types of articles being the group from which a plurality of articles are selected and wherein different types of articles are selectable during the step of selecting, the selected articles then being moved to the packaging area and being combined into a single package during the steps of grouping, packing and stationarily holding.

38. The method of packaging and vending as recited in claim 29, wherein the step of grouping comprises the steps of:

dropping selected articles from the group of articles in the vending machine housing onto a ramp below the group of articles; and gravity feeding the selected articles on the ramp away from an area beneath the group of articles stored in the vending machine housing.

39. The method of packaging and vending as recited in claim 38, wherein the step of grouping further comprises the step of elevating articles gravity fed to an end of the ramp to the packaging area.

40. The method of packaging and vending as recited in claim 29, further comprising the steps of:

discharging selected articles from the storage area to a first ramp section;

moving the selected articles from the first ramp section to a discharge ramp section, the first and discharge ramp sections being generally perpendicular;

unloading the selected articles from the discharge ramp section to an elevator;

moving the selected articles on the elevator to the packaging area; and discharging the selected articles from the elevator to the packaging area for subsequent packaging thereof.

41. The method of packaging and vending as recited in claim 40, wherein the step of unloading selected articles to the elevator includes the step of unloading more than one selected article onto the elevator such that plural selected articles can be simultaneously handled by the elevator.

42. A machine for packaging and vending selected packages of vending objects comprising:

a vending machine body for housing a stock of vending objects;

a selection device for receiving a selection of a plurality of vending objects to be packaged together;

a packaging device housed within the vending machine body and in operative communication with the selection device for packaging together each of a selected plurality of vending objects within a selected package in response to the selection of vending objects received by the selection device; and a dispensing device for allowing the selected package of the selected plurality of vending objects to be dispensed between a first position inside the vending machine body and a second position outside the vending machine body.

43. The vending machine of claim 42, wherein the stock of vending objects comprise a plurality of different types of beverages.

44. The vending machine of claim 42, wherein the stock of vending objects comprise a plurality of different types of containers.

45. The vending machine of claim 42, wherein the dispensing devise comprises a port opening.

46. The vending machine of claim 42, further comprising a storage area for storing the stock of vending objects within the vending machine body.

47. The vending machine of claim 42, wherein the selection device is displayed on an external surface of the vending machine body.

48. The vending machine as recited in claim 42, wherein the plurality of vending objects comprise a plurality of different types of containers and the selection device comprises a plurality of buttons for sequentially receiving a series of selections of the plurality of different types of containers to be packaged into the selected package.

49. The vending machine as recited in claim 42, wherein the plurality of vending objects comprise six different types of beverages and the selection device comprises a button display for receiving a selection of six different types of beverages to be packed into the selected package by the packaging device.

50. The vending machine as recited in claim 42, wherein the selection device is configured to provide a consumer with an opportunity to select different types of vending articles to be combined into a package vended to the consumer.

51. The vending machine as recited in claim 42, wherein the selected package comprises six containers connected together by a carrier and the packaging device comprises a carrier attaching device for attaching each of the six containers to the carrier so as to form the selected package.

52. A method of packaging and vending selected packages of vending objects comprising the steps of:

housing a stock of vending objects within a vending machine body;

receiving a selection of a plurality of vending objects to be packaged together;

packaging together each of a selected plurality of vending objects within a selected package in accordance with the selection of the plurality of vending objects; and dispensing the selected package of the selected plurality of vending objects between a packaging area inside the vending machine body and a reception area outside the vending machine body.

53. The method of packaging and vending of claim 52, wherein the step of housing comprises housing a plurality of different types of beverage containers.

54. The method of packaging and vending of claim 52, wherein the receiving step comprises sequentially receiving a series of selections of a plurality of different types of containers to be packaged into the selected package.

55. The method of packaging and vending of claim 52, wherein the receiving step comprises receiving a selection of six different types of beverages to be packed into the selected package by the packaging device.

56. The method of packaging and vending of claim 52, wherein the receiving step comprises the substep of providing a consumer with an opportunity to select different types of vending articles to be combined into a package vended to the consumer.

57. The vending machine as recited in claim 52, wherein the step of packaging comprises attaching each of six containers to a carrier so as to form the selected package.

* * * * *

UNITED STATES PATENT AND TRADEMARK OFFICE

CERTIFICATE OF CORRECTION

PATENT NO.: 6,112,497

DATED: September 5, 2000

INVENTOR: William S. CREDLE, Jr.

It is certified that errors appear in the above-identified patent and that said Letters Patent is hereby corrected as shown below:

On the Title Page, in the Attorney, Agent, or Firm, L. 2, "L..L.P." should read --L.L.P.--

CLAIM 13, Col. 14, L. 67, "carriers an" should read --carriers and--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*